US011232807B2

(12) United States Patent
Hines et al.

(10) Patent No.: US 11,232,807 B2
(45) Date of Patent: Jan. 25, 2022

(54) BACKGROUND NOISE ESTIMATION USING GAP CONFIDENCE

(71) Applicant: DOLBY LABORATORIES LICENSING CORPORATION, San Francisco, CA (US)

(72) Inventors: Christopher Graham Hines, Sydney (AU); Glenn N. Dickins, Como (AU); Adam J. Mills, Oran Park (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 17/049,029

(22) PCT Filed: Apr. 24, 2019

(86) PCT No.: PCT/US2019/028951
§ 371 (c)(1),
(2) Date: Oct. 20, 2020

(87) PCT Pub. No.: WO2019/209973
PCT Pub. Date: Oct. 31, 2019

(65) Prior Publication Data

US 2021/0249029 A1 Aug. 12, 2021

Related U.S. Application Data

(60) Provisional application No. 62/663,302, filed on Apr. 27, 2018.

(30) Foreign Application Priority Data

Jun. 14, 2018 (EP) ..... 18177822

(51) Int. Cl.
*G10L 21/0232* (2013.01)
*H04R 1/08* (2006.01)
(Continued)

(52) U.S. Cl.
CPC ..... *G10L 21/0232* (2013.01); *H04R 1/08* (2013.01); *G10L 2021/02082* (2013.01); *G10L 2021/02163* (2013.01); *H04R 3/02* (2013.01)

(58) Field of Classification Search
None
See application file for complete search history.

(56) References Cited

U.S. PATENT DOCUMENTS 5,907,622 A 5/1999 Dougherty
6,526,140 B1 2/2003 Marchok
(Continued)

OTHER PUBLICATIONS

Dahl, M. et al "Simultaneous Echo Cancellation and Car Noise Suppression Employing a Microphone Array" Apr. 24, 1997, Acoustics, Speech and Signal Processing.
(Continued)

*Primary Examiner* — Kenny H Truong

(57) ABSTRACT

A noise estimation method including steps of generating gap confidence values in response to microphone output and playback signals, and using the gap confidence values to generate an estimate of background noise in a playback environment. Each gap confidence value is indicative of confidence of presence of a gap at a corresponding time in the playback signal, and may be a combination of candidate noise estimates weighted by the gap confidence values. Generation of the candidate noise estimates may but need not include performance of echo cancellation. Optionally, noise compensation is performed on an audio input signal using the generated background noise estimate. Other aspects are systems configured to perform any embodiment of the noise estimation method.

17 Claims, 3 Drawing Sheets

(51) Int. Cl.

| | |
|---|---|
| ***G10L 21/0208*** | (2013.01) |
| ***G10L 21/0216*** | (2013.01) |
| ***H04R 3/02*** | (2006.01) |

(56) References Cited

U.S. PATENT DOCUMENTS

| | | | |
|---|---|---|---|
| 6,674,865 | B1 | 1/2004 | Venkatesh |
| 7,606,376 | B2 | 10/2009 | Eid |
| 7,756,280 | B2 | 7/2010 | Hsieh |
| 7,968,786 | B2 | 6/2011 | Kemmochi |
| 8,005,231 | B2 | 8/2011 | Shuttleworth |
| 8,103,008 | B2 | 1/2012 | Johnston |
| 8,270,626 | B2 | 9/2012 | Shridhar |
| 8,498,430 | B2 | 7/2013 | Hess |
| 8,611,548 | B2 | 12/2013 | Bizjak |
| 8,649,526 | B2 | 2/2014 | Vernon |
| 8,705,753 | B2 | 4/2014 | Haulick |
| 8,781,137 | B1 | 7/2014 | Goodwin |
| 8,908,884 | B2 | 12/2014 | Mantegna |
| 9,208,766 | B2 | 12/2015 | Su |
| 9,330,654 | B2 | 5/2016 | Nicholson |
| 9,357,307 | B2 | 5/2016 | Taenzer |
| 9,363,600 | B2 | 6/2016 | Yang |
| 9,516,407 | B2 | 12/2016 | Goldstein |
| 9,705,461 | B1 | 7/2017 | Seefeldt |
| 9,706,305 | B2 | 7/2017 | Aggarwal |
| 2009/0034747 | A1 | 2/2009 | Christoph |
| 2010/0329471 | A1 | 12/2010 | Dunn |
| 2011/0200200 | A1 | 8/2011 | Avayu |
| 2011/0293103 | A1 | 12/2011 | Park |
| 2015/0003625 | A1 | 1/2015 | Uhle |
| 2015/0171813 | A1 | 6/2015 | Ganatra |
| 2016/0343385 | A1 | 11/2016 | Hetherington |
| 2017/0164125 | A1 | 6/2017 | Song |
| 2018/0091883 | A1* | 3/2018 | Howes ..... H04R 1/1008 |
| 2018/0140233 | A1 | 5/2018 | Lacirignola |

OTHER PUBLICATIONS

Lu, Z. et al "A Volume Control United Based on TMS320C54" Aug.-Sep. 2004.

Sack, M.C. et al "Loudness and Auditory Masking Compensation for Mobile TV" Jul. 2, 2005, IEEE International Symposium on Broadband Multimedia Systems and Broadcasting, 6pp, 2010.

* cited by examiner

BACKGROUND NOISE ESTIMATION USING GAP CONFIDENCE

CROSS REFERENCE TO RELATED APPLICATIONS

This application claims priority to U.S. Provisional Application No. 62/663,302, filed Apr. 27, 2018 and European Patent Application No. 18177822.6, filed Jun. 14, 2018, each of which is incorporated by reference in its entirety.

TECHNICAL FIELD

The invention pertains to systems and methods for estimating background noise in an audio signal playback environment, and processing (e.g., performing noise compensation on) an audio signal for playback using the noise estimate. In some embodiments, the noise estimation includes determination of gap confidence values, each indicative of confidence that there is a gap (at a corresponding time) in the playback signal, and use of the gap confidence values to determine a sequence of background noise estimates.

BACKGROUND

The ubiquity of portable electronics means that people are engaging with audio on a day to day basis in many different environments. For example, listening to music, watching entertainment content, listening for audible notifications and directions, and participating in a voice call. The listening environments in which these activities take place can often be inherently noisy, with constantly changing background noise conditions, which compromises the enjoyment and intelligibility the listening experience. Placing the user in the loop of manually adjusting the playback level in response to changing noise conditions distracts the user from the listening task, and heightens the cognitive load required to engage in audio listening tasks.

Noise compensated media playback (NCMP) alleviates this problem by adjusting the volume of any media being played to be suitable for the noise conditions in which the media is being played back in. The concept of NCMP is well known, and many publications claim to have solved the problem of how to implement it effectively.

While a related field called Active Noise Cancellation attempts to physically cancel interfering noise through the re-production of acoustic waves, NCMP adjusts the level of playback audio so that the adjusted audio is audible and clear in the playback environment in the presence of background noise.

The primary challenge in any real implementation of NCMP is the automatic determination of the present background noise levels experienced by the listener, particularly in situations where the media content is being played over speakers where background noise and media content are highly acoustically coupled. Solutions involving a microphone are faced with the issue of the media content and noise conditions being observed (detected by the microphone) together.

A typical audio playback system implementing NCMP is shown in FIG. 1. The system includes content source 1 which outputs, and provides to noise compensation subsystem 2, an audio signal indicative of audio content (sometimes referred to herein as media content or playback content). The audio signal is intended to undergo playback to generate sound (in an environment) indicative of the audio content. The audio signal may be a speaker feed (and noise compensation subsystem 2 may be coupled and configured to apply noise compensation thereto by adjusting the playback gains of the speaker feed) or another element of the system may generate a speaker feed in response to the audio signal (e.g., noise compensation subsystem 2 may be coupled and configured to generate a speaker feed in response to the audio signal and to apply noise compensation to the speaker feed by adjusting the playback gains of the speaker feed).

The FIG. 1 system also includes noise estimation system 5, at least one speaker 3 (which is coupled and configured to emit sound indicative of the media content) in response to the audio signal (or a noise compensated version of the audio signal generated in subsystem 2), and microphone 4, coupled as shown. In operation, microphone 4 and speaker 3 are in a playback environment (e.g., a room) and microphone 4 generates a microphone output signal indicative of both background (ambient) noise in the environment and an echo of the media content. Noise estimation subsystem 5 (sometimes referred to herein as a noise estimator) is coupled to microphone 4 and configured to generate an estimate (the "noise estimate" of FIG. 1) of the current background noise level(s) in the environment using the microphone output signal. Noise compensation subsystem 2 (sometimes referred to herein as a noise compensator) is coupled and configured to apply noise compensation by adjusting (e.g., adjusting playback gains of) the audio signal (or adjusting a speaker feed generated in response to the audio signal) in response to the noise estimate produced by subsystem 5, thereby generating a noise compensated audio signal indicative of compensated media content (as indicated in FIG. 1). Typically, subsystem 2 adjusts the playback gains of the audio signal so that the sound emitted in response to the adjusted audio signal is audible and clear in the playback environment in the presence of background noise (as estimated by noise estimation subsystem 5).

As will be described below, a background noise estimator (e.g., noise estimator 5 of FIG. 1) for use in an audio playback system which implements noise compensation, can be implemented in accordance with a class of embodiments of the present invention.

Numerous publications have engaged with the issue of noise compensated media playback (NCMP), and an audio system that compensates for background noise can work to many degrees of success.

It has been proposed to perform NCMP without a microphone, and instead to use other sensors (e.g., a speedometer in the case of an automobile). However, such methods are not as effective as microphone based solutions which actually measure the level of interfering noise experienced by the listener. It has also been proposed to perform NCMP with reliance on a microphone located in an acoustic space which is decoupled from sound indicative of the playback content, but such methods are prohibitively restrictive for many applications.

The NCMP methods mentioned in the previous paragraph do not attempt to measure noise level accurately using a microphone which also captures the playback content, due to the "echo problem" arising when the playback signal captured by the microphone is mixed with the noise signal of interest to the noise estimator. Instead these methods either try to ignore the problem by constraining the compensation they apply such that an unstable feedback loop does not form, or by measuring something else that is somewhat predictive of the noise levels experienced by the listener.

It has also been proposed to address the problem of estimating background noise from a microphone output signal (indicative of both background noise and playback content) by attempting to correlate the playback content with the microphone output signal and subtracting off an estimate of the playback content captured by the microphone (referred to as the "echo") from the microphone output. The content of a microphone output signal generated as the microphone captures sound, indicative of playback content X emitted from speaker(s) and background noise N, can be denoted as WX+N, where W is a transfer function determined by the speaker(s) which emit the sound indicative of playback content, the microphone, and the environment (e.g., room) in which the sound propagates from the speaker(s) to the microphone. For example, in an academically proposed method (to be described with reference to FIG. 2) for estimating the noise N, a linear filter W' is adapted to facilitate an estimate, W'X, of the echo (playback content captured by the microphone), WX, for subtraction from the microphone output signal. Even if nonlinearities are present in the system, a nonlinear implementation of filter W' is rarely implemented due to computational cost.

FIG. 2 is a diagram of a system for implementing the above-mentioned conventional method (sometimes referred to as echo cancellation) for estimating background noise in an environment in which speaker(s) emit sound indicative of playback content. A playback signal X is presented to a speaker system S (e.g., a single speaker) in environment E. Microphone M is located in the same environment E. In response to playback signal X, speaker system S emits sound which arrives (with any environmental noise N present in environment E) at microphone M. The microphone output signal is Y=WX+N, where W denotes a transfer function which is the combined response of the speaker system S, playback environment E, and microphone M. The general method implemented by the FIG. 2 system is to adaptively infer the transfer function W from Y and X, using any of various adaptive filter methods. As indicated in FIG. 2, linear filter W' is adaptively determined to be an approximation of transfer function W.' The playback signal content (the "echo") indicated by microphone signal M is estimated as W'X, and W'X is subtracted from Y to yield an estimate, Y'=WX−W'X+N, of the noise N. Adjusting the level of X in proportion to Y' produces a feedback loop if a positive bias exists in the estimation. An increase in Y' in turn increases the level of X, which introduces an upward bias in the estimate (Y') of N, which in turn increases the level of X and so on. A solution in this form would rely heavily on the ability of the adaptive filter W' to cause subtraction of W'X from Y to remove a significant amount of the echo WX from the microphone signal M.

Further filtering of the signal Y' is usually required in order to keep the FIG. 2 system stable. As most noise compensation embodiments in the field exhibit lacklustre performance, it is likely that most solutions typically bias noise estimates downward and introduce aggressive time smoothing in order to keep the system stable. This comes at the cost of reduced and very slow acting compensation.

Conventional implementations of systems (of the type described with reference to FIG. 2) which are claimed to implement the above-mentioned academic method for noise estimation usually ignore issues that come with the implemented process, including some or all of the following:

despite academic simulations of solutions indicating upwards of 40 dB of echo reduction, real implementations are limited to around 20 dB due to non-linearities, the presence of background noise, and the non-stationarity of the echo path W. This means that any measurements of background noise will be biased by the residual echo;

there are times when environmental noise and particular playback content cause "leakage" in such systems (e.g., when playback content excites the non-linear region of the playback system, due to buzz, rattle, and distortion). In these instances the microphone output signal contains a significant amount of residual echo which will be incorrectly interpreted as background noise. In such instances, the adaption of filter W' can also become unstable, as the residual error signal becomes large. Also, when the microphone signal is compromised by a high level of noise, adaption of filter W' can become unstable; and the computational complexity required for generating a noise estimate (Y') useful for performing NCMP operating over a wide frequency range (e.g., one that covers the playback of typical music) is high.

Noise compensation (e.g., automatically levelling of speaker playback content) to compensate for environmental noise conditions is a well-known and desired feature, but has not yet been convincingly implemented. Using a microphone to measure environmental noise conditions also measures the speaker playback content, presenting a major challenge for noise estimation (e.g., online noise estimation) needed to implement noise compensation.

Typical embodiments of the present invention are noise estimation methods and systems which generate, in an improved manner, a noise estimate useful for performing noise compensation (e.g., to implement many embodiments of noise compensated media playback). The noise estimation implemented by typical implementations of such methods and systems has a simple formulation.

BRIEF DESCRIPTION OF THE INVENTION

In a class of embodiments, the inventive method (e.g., a method of generating an estimate of background noise in a playback environment) includes steps of:

during emission of sound in a playback environment, using a microphone to generate a microphone output signal, wherein the sound is indicative of audio content of a playback signal, and the microphone output signal is indicative of background noise in the playback environment and the audio content;

generating gap confidence values (i.e., signal(s) or data indicative of gap confidence values) in response to the microphone output signal (e.g., in response to smoothed level of the microphone output signal) and the playback signal, where each of the gap confidence values is for a different time, t (e.g., a different time interval including the time, t), and is indicative of confidence that there is a gap, at the time t, in the playback signal; and generating an estimate of the background noise in the playback environment using the gap confidence values.

The playback environment may relate to an acoustic environment or acoustic space in which the sound is emitted. For example, the playback environment may be that acoustic environment in which the sound is emitted (e.g., by a loudspeaker in response to the playback signal).

Typically, the estimate of the background noise in the playback environment is or includes a sequence of noise estimates, each of the noise estimates is indicative of background noise in the playback environment at a different time, t, and said each of the noise estimates is a combination of candidate noise estimates which have been weighted by the gap confidence values for a different time interval including the time t. As such, generating the estimate of the background noise in the playback environment using the gap confidence values may involve, for each noise estimate, weighting candidate noise estimates for a different time interval including the time t by the gap confidence values and combining the weighted candidate noise estimates to obtain the respective noise estimate.

The candidate noise estimates may have different reliabilities (e.g., as to whether they faithfully represent the noise to be estimated). Their reliabilities may be indicated by respective gap confidence values. The method may consider the candidate noise estimates for the time interval that includes the time t (e.g., a sliding analysis window that includes the time t), with one candidate noise estimate for each time within the interval, and weight each candidate noise estimate with its respective gap confidence value (e.g., the gap confidence value for the respective time within the interval). As such, generating the estimate of the background noise in the playback environment using the gap confidence values may involve weighting the candidate noise estimates with their respective gap confidence values and combining the weighted candidate noise estimates. In other words, for each time t, an interval (e.g., sliding analysis window) including the time t is considered. The interval may contain, for each time within the interval, a candidate noise estimate. The actual noise estimate for the time t may then be obtained by combining the candidate noise estimates for the interval including the time t, in particular by combining the weighted candidate noise estimates, each candidate noise estimate weighted with the gap confidence value for the time of the respective candidate noise estimate.

For example, each of the candidate noise estimates may be a minimum echo cancelled noise estimate, $M_{resmin}$, of a sequence of echo cancelled noise estimates (generated by echo cancellation), and the noise estimate for each said time interval may be a combination of the minimum echo cancelled noise estimates for the time interval, weighted by corresponding ones of the gap confidence values for the time interval. The minimum echo cancelled noise estimate may relate to a minimum value of the sequence of echo cancelled noise estimates. For example, the minimum echo cancelled noise estimate may be obtained by performing minimum following on the sequence of echo cancelled noise estimates Minimum following may operate using an analysis window of a given length/size. Then, a minimum echo cancelled noise estimate may be the minimum value of echo cancelled noise estimates within the analysis window. The echo cancelled noise estimates are typically calibrated echo cancelled noise estimates, which have undergone calibration to bring them into the same level domain as the playback signal. For another example, each of the candidate noise estimates may be a minimum calibrated microphone output signal value, $M_{min}$, of a sequence of microphone output signal values, and the noise estimate for said each time interval may be a combination of the minimum microphone output signal values for the time interval, weighted by corresponding ones of the gap confidence values for the time interval. The microphone output signal values are typically calibrated microphone output signal values, which have undergone calibration to bring them into the same level domain as the playback signal.

In a class of embodiments, the candidate noise estimates are processed in a minimum follower (of gap confidence weighted samples), in the sense that minimum follower processing is performed on candidate noise estimates in each of a sequence of different time intervals. The minimum follower includes each candidate sample (each value of the candidate noise estimates for a time interval) in its analysis window only if the associated gap confidence is higher than a predetermined threshold value (e.g., the minimum follower assigns a weight of one to a candidate sample if the gap confidence for the sample is equal to or greater than the threshold value, and the minimum follower assigns a weight of zero to a candidate sample if the gap confidence for the sample is less than the threshold value). In this class of embodiments, generation of the noise estimate for each time interval includes steps of: (a) identifying each of the candidate noise estimates for the time interval for which a corresponding one of the gap confidence values exceeds a predetermined threshold value; and (b) generating the noise estimate for the time interval to be a minimum one of the candidate noise estimates identified in step (a).

In a typical embodiment, each gap confidence value (i.e., the gap confidence value for time t) is indicative of how different a minimum ($S_{min}$) in playback signal level is from a smoothed level ($M_{smoothed}$) of the microphone output signal (at the time t). The further the $S_{min}$ value is from the smoothed level $M_{smoothed}$, the greater is the confidence that there is a gap in playback content at the time t, and thus the greater is the confidence that a candidate noise estimate for the time t (e.g., the value $M_{resmin}$ or $M_{min}$ for the time t) is indicative of the background noise (at the time t) in the playback environment.

Typically, the method includes steps of generating a sequence of the gap confidence values, and generating a sequence of background noise estimates using the gap confidence values. Some embodiments of the method also include a step of performing noise compensation on an audio input signal using the sequence of background noise estimates.

Some embodiments perform echo cancellation (in response to the microphone output signal and the playback signal) to generate the candidate noise estimates. Other embodiments generate the candidate noise estimates without a step of performing echo cancellation.

Some embodiments of the invention include one or more of the following aspects:

One such aspect relates to determination of gaps in playback content (using data indicative of confidence in the presence of each of the gaps) and generation of background noise estimates (e.g., by implementing sampling gaps, corresponding to playback content gaps, in gap confidence weighted candidate noise estimates). Some embodiments generate candidate noise estimates, weight the candidate noise estimates with gap confidence data values to generate gap confidence weighted candidate noise estimates, and generate the background noise estimates using the gap confidence weighted candidate noise estimates. In some embodiments, generation of the candidate noise estimates includes a step of performing echo cancellation. In other embodiments, generation of the candidate noise estimates does not include a step of performing echo cancellation.

Another such aspect relates to a method and system that employs background noise estimates generated in accordance with any embodiment of the invention to perform noise compensation on an input audio signal (e.g., noise compensated media playback).

Another such aspect relates to a method and system that estimates background noise in a playback environment, thereby generating background noise estimates useful for performing noise compensation on an input audio signal (e.g., noise compensated media playback). In some such embodiments, the method and/or system also performs self-calibration (e.g., determination of calibration gains for application to playback signal, microphone output signal, and/or echo cancellation residual values to implement noise estimation), and/or automatic detection of system failure (e.g., hardware failure), when echo cancellation (AEC) is employed in the generation of background noise estimates.

Aspects of the invention further include a system configured (e.g., programmed) to perform any embodiment of the inventive method or steps thereof, and a tangible, non-transitory, computer readable medium which implements non-transitory storage of data (for example, a disc or other tangible storage medium) which stores code for performing (e.g., code executable to perform) any embodiment of the inventive method or steps thereof. For example, embodiments of the inventive system can be or include a programmable general purpose processor, digital signal processor, or microprocessor, programmed with software or firmware and/or otherwise configured to perform any of a variety of operations on data, including an embodiment of the inventive method or steps thereof. Such a general purpose processor may be or include a computer system including an input device, a memory, and a processing subsystem that is programmed (and/or otherwise configured) to perform an embodiment of the inventive method (or steps thereof) in response to data asserted thereto.

NOTATION AND NOMENCLATURE

Throughout this disclosure, including in the claims, a "gap" in a playback signal denotes a time (or time interval) of the playback signal at (or in) which playback content is missing (or has a level less than a predetermined threshold).

Throughout this disclosure, including in the claims, "speaker" and "loudspeaker" are used synonymously to denote any sound-emitting transducer (or set of transducers) driven by a single speaker feed. A typical set of headphones includes two speakers. A speaker may be implemented to include multiple transducers (e.g., a woofer and a tweeter), all driven by a single, common speaker feed (the speaker feed may undergo different processing in different circuitry branches coupled to the different transducers).

Throughout this disclosure, including in the claims, the expression performing an operation "on" a signal or data (e.g., filtering, scaling, transforming, or applying gain to, the signal or data) is used in a broad sense to denote performing the operation directly on the signal or data, or on a processed version of the signal or data (e.g., on a version of the signal that has undergone preliminary filtering or pre-processing prior to performance of the operation thereon).

Throughout this disclosure including in the claims, the expression "system" is used in a broad sense to denote a device, system, or subsystem. For example, a subsystem that implements a decoder may be referred to as a decoder system, and a system including such a subsystem (e.g., a system that generates X output signals in response to multiple inputs, in which the subsystem generates M of the inputs and the other X−M inputs are received from an external source) may also be referred to as a decoder system.

Throughout this disclosure including in the claims, the term "processor" is used in a broad sense to denote a system or device programmable or otherwise configurable (e.g., with software or firmware) to perform operations on data (e.g., audio, or video or other image data). Examples of processors include a field-programmable gate array (or other configurable integrated circuit or chip set), a digital signal processor programmed and/or otherwise configured to perform pipelined processing on audio or other sound data, a programmable general purpose processor or computer, and a programmable microprocessor chip or chip set.

Throughout this disclosure including in the claims, the term "couples" or "coupled" is used to mean either a direct or indirect connection. Thus, if a first device couples to a second device, that connection may be through a direct connection, or through an indirect connection via other devices and connections.

DETAILED DESCRIPTION OF EMBODIMENTS

Many embodiments of the present invention are technologically possible. It will be apparent to those of ordinary skill in the art from the present disclosure how to implement them. Some embodiments of the inventive system and method are described herein with reference to FIGS. 3 and 4.

Figure 3:
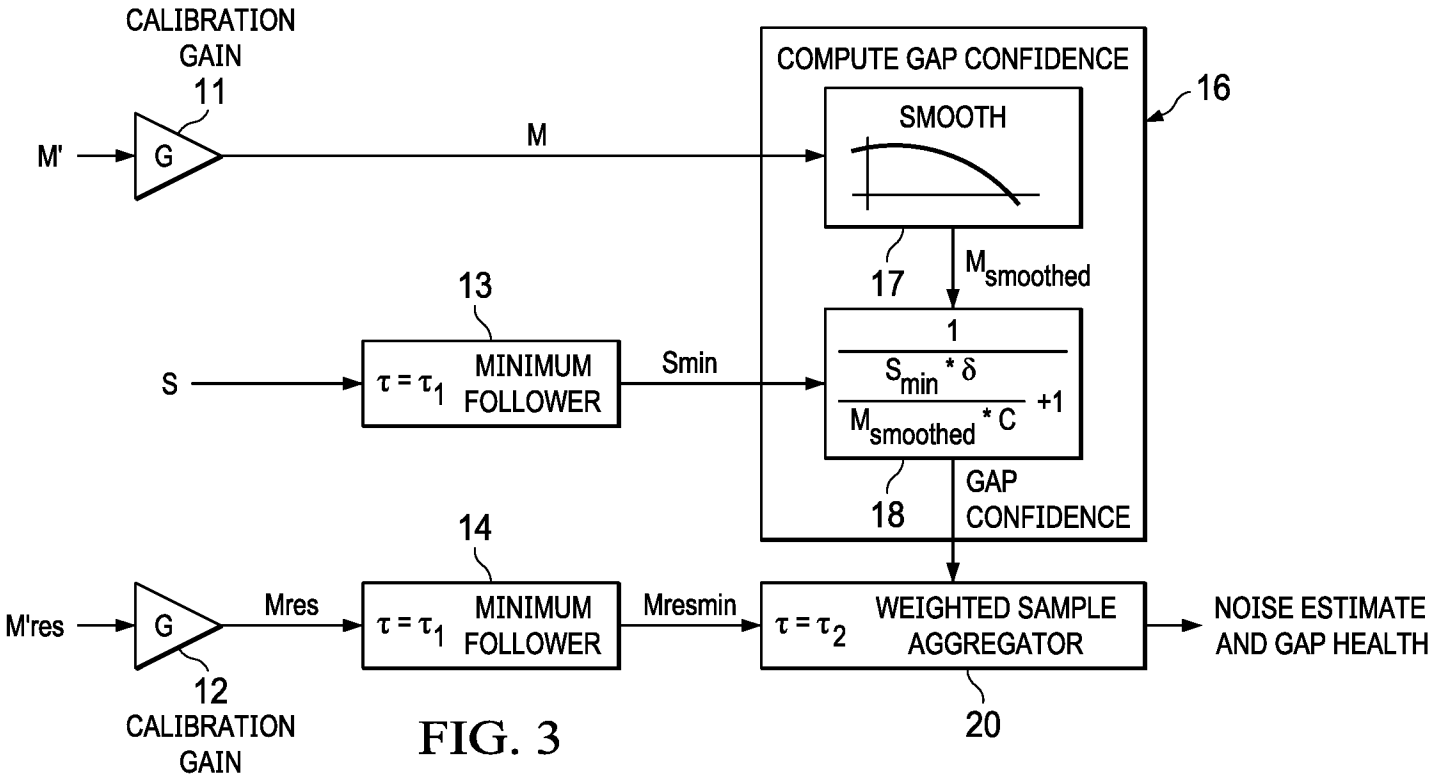
FIG. 3 is a block diagram of an embodiment of the inventive system for generating a noise level estimate for each frequency band of a microphone output signal. Typically, the microphone output signal is generated by capturing sound (indicative of playback content) and noise in a playback environment.
Figure 4:
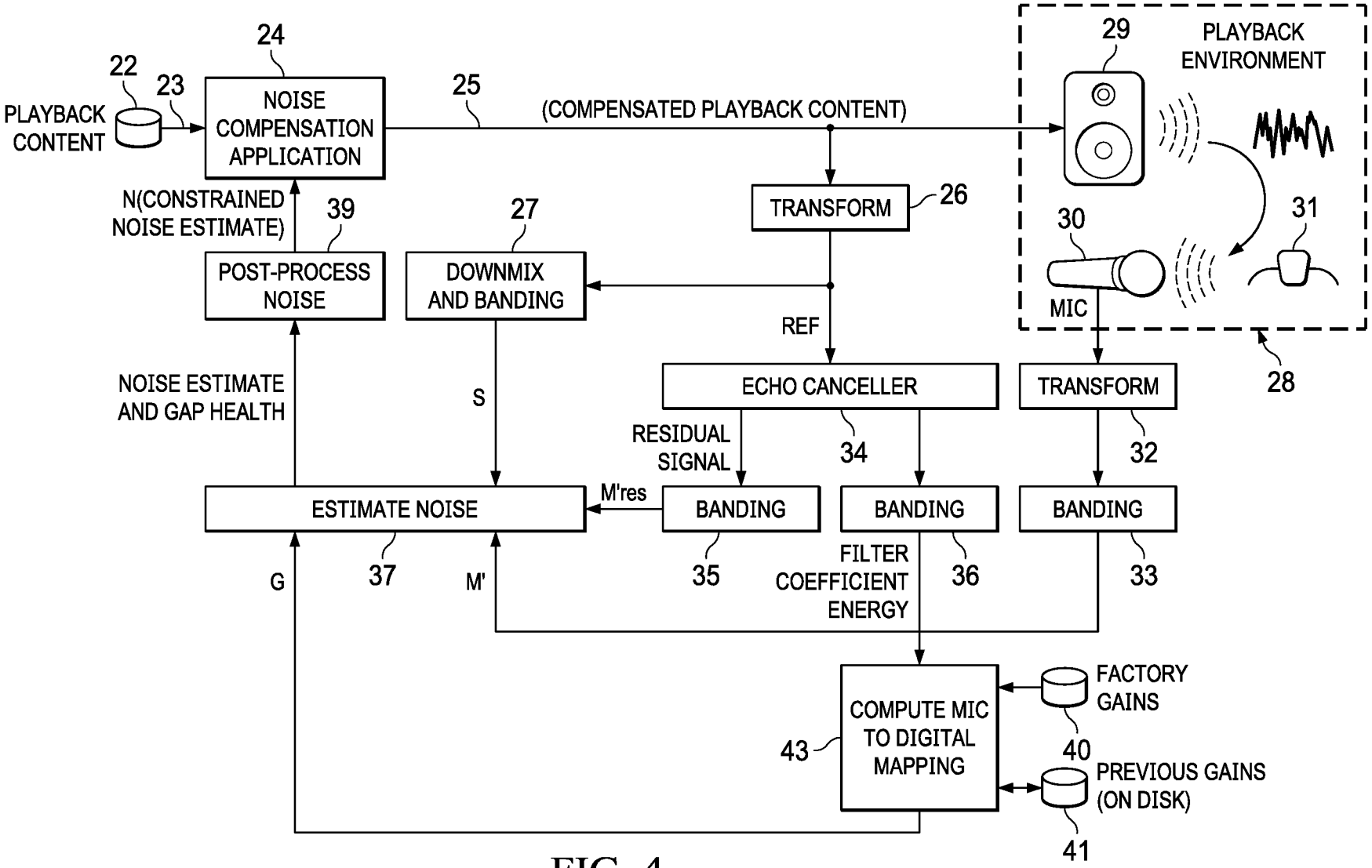
FIG. 4 is a block diagram of an implementation of noise estimate generating subsystem 37 of the FIG. 4 system

The system of FIG. 4 is configured to generate an estimate of background noise in playback environment 28 and to use the noise estimate to perform noise compensation on an input audio signal. FIG. 3 is a block diagram of an implementation of noise estimation subsystem 37 of the FIG. 4 system.

Noise estimation subsystem 37 of FIG. 4 is configured to generate a background noise estimate (typically a sequence of noise estimates, each corresponding to a different time interval) in accordance with an embodiment of the inventive noise estimation method. The FIG. 4 system also includes noise compensation subsystem 24, which is coupled and configured to perform noise compensation on input audio signal 23 using the noise estimate output from subsystem 37 (or a post-processed version of such noise estimate, which is output from post-processing subsystem 39 in cases in which subsystem 39 operates to modify the noise estimate output from subsystem 37) to generate a noise compensated version (playback signal 25) of input signal 23.

The FIG. 4 system includes content source 22, which is coupled and configured to output, and provide to noise compensation subsystem 24, the audio signal 23. Signal 23 is indicative of at least one channel of audio content (sometimes referred to herein as media content or playback content), and is intended to undergo playback to generate sound (in environment 28) indicative of each channel of the audio content. Audio signal 23 may be a speaker feed (or two or more speaker feeds in the case of multichannel playback content) and noise compensation subsystem 24 may be coupled and configured to apply noise compensation to each such speaker feed by adjusting the playback gains of the speaker feed. Alternatively, another element of the system may generate a speaker feed (or multiple speaker feeds) in response to audio signal 23 (e.g., noise compensation subsystem 24 may be coupled and configured to generate at least one speaker feed in response to audio signal 23 and to apply noise compensation to each speaker feed by adjusting the playback gains of the speaker feed, so that playback signal 25 consists of at least one noise compensated speaker feed). In an operating mode of the FIG. 4 system, subsystem 24 does not perform noise compensation, so that the audio content of the playback signal 25 is the same as the audio content of signal 23.

Speaker system 29 (including at least one speaker) is coupled and configured to emit sound (in playback environment 28) in response to playback signal 25. Signal 25 may consist of a single playback channel, or it may consist of two or more playback channels. In typical operation, each speaker of speaker system 29 receives a speaker feed indicative of the playback content of a different channel of signal 25. In response, speaker system 29 emits sound (in playback environment 28) in response to the speaker feed(s). The sound is perceived by listener 31 (in environment 28) as a noise-compensated version of the playback content of input signal 23.

The other elements of the FIG. 4 system will be described below.

The present disclosure will refer to the following three types of background noise:

distracting noise (e.g., impulsive and infrequent events (e.g., having duration less than 0.5 second), such as for example doors slamming, automobile sounding horn, driving over a road bump);

disrupting (short events that interfere with playback content, e.g., overhead airplane passing, driving through a short tunnel, driving over a section of new road surface); and pervasive (persistent/constant noise that can start and stop, but generally remains steady, e.g., air conditioning, fans, ambient metropolitan noise, rain, kitchen appliances).

In order of importance based on experimentation by the inventors, the characteristics of successful noise compensation include the following:

stability (the noise estimate should not be corrupted by the playback content measured at the microphone. The noise estimate and therefore compensation gain should not fluctuate in a noticeable way due to changes in playback content. No noise estimate should track anything faster than the "disrupting" sources of noise. A noise estimate should ignore "distracting" impulsive events);

fast reaction time (a good noise estimate will track only the "pervasive" sources of noise. A great noise estimate however will also be reliably able to track "disrupting" sources of noise. Reacting quickly to a change in noise conditions is highly important to the user experience); and comfortable compensation amount (noise compensation should ensure preserved intelligibility and timbre in the presence of noise. Compensating too low or too high makes the user experience unsatisfactory. Compensation is performed in a multi-band sense, with more fidelity than a bulk volume adjustment).

Noise estimation using minimum following filters to track stationary noise is an established art. To perform such estimation, a minimum follower filter accumulates input samples into a sliding fixed size buffer called the analysis window, and outputs the smallest sample value in that buffer Minimum following removes impulsive, distracting sources of noise, for both short and long analysis windows. A long analysis window (having duration on the order of 10 sec) is effective at locating a stationary noise floor (pervasive noise), as the minimum follower will hold onto minima that occur during gaps in the playback content, and in between any user's speech in the vicinity of the microphone. The longer the analysis window, it is more likely that a gap will be found. However, this approach will follow minima regardless of whether they are actually gaps in the playback content or not. Furthermore, a long analysis window causes the system to take a long time to track upwards to increases in background noise, which becomes a significant disadvantage for noise compensation. A long analysis window will typically track pervasive source of noise eventually, but miss out on tracking disruptive sources of noise.

An important aspect of typical embodiments of the present invention is to use knowledge of the playback signal to decide when conditions are most favorable to measure the noise estimate from the microphone output (and optionally also from an echo cancelled noise estimate, generated by performing echo cancellation on the microphone output). Realistic playback signals viewed in the time-frequency domain will typically contain points where the signal energy is low, which implies that those points in time and frequency are good opportunities to measure the ambient noise conditions. An important aspect of typical embodiments of the present invention is a method of quantifying how good these opportunities are (e.g., by assigning to each of them a value to be referred to as a "gap confidence" value or "gap confidence"). Approaching the problem in this way makes noise compensation (or noise estimation) possible for many types of content without requiring an echo canceller (to generate an echo cancelled noise estimate) and lowers the requirements of an echo canceller's performance (when an echo canceller is used).

Next, with reference to FIGS. 3 and 4, we describe an embodiment of the inventive method and system for computing a sequence of estimates of background noise level for each band of a number of different frequency bands of playback content. FIG. 4 is a block diagram of the system, and FIG. 3 is a block diagram of an implementation of subsystem 37 of the FIG. 4 system. It should be appreciated that the elements of FIG. 4 (excluding playback environment 28, speaker system 29, microphone 30, and listener 31) can be implemented in or as a processor, with those of such elements (including those referred to herein as subsystems) which perform signal (or data) processing operations implemented in software, firmware, or hardware.

A microphone output signal (e.g., signal "Mic" of FIG. 4) is generated using a microphone (e.g., microphone 30 of FIG. 4) occupying the same acoustic space (environment 28 of FIG. 4) as the listener (e.g., listener 31 of FIG. 4). It is possible that two or more microphones could be used (e.g., with their individual outputs combined) to generate the microphone output signal, and thus the term "microphone" is used in a broad sense herein to denote either a single microphone, or two or more microphones, operated to generate a single microphone output signal. The microphone output signal is indicative of both the acoustic playback signal (the playback content of the sound emitted from speaker system 29 of FIG. 4) and the competing background noise, and is transformed (e.g., by time-to-frequency transform element 32 of FIG. 4) into a frequency domain representation, thereby generating frequency-domain microphone output data, and the frequency-domain microphone output data is banded (e.g., by element 33 of FIG. 4) into the power domain, yielding microphone output values (e.g., values M' of FIG. 3 and FIG. 4). For each frequency band, the corresponding one of the values (one of values M') is adjusted in level using a calibration gain G (e.g., applied by gain stage 11 of FIG. 3) to produce an adjusted value M (e.g., one of values M of FIG. 3). Application of the calibration gain G is required to correct for the level difference in the digital playback signal (the values S) and the digitized microphone output signal level (the values M'). Methods for determining G (for each frequency band) automatically and through measurement are discussed below.

Each channel of the playback content (e.g., each channel of noise compensated signal 25 of FIG. 4), which is typically multichannel playback content, is frequency transformed (e.g., by time-to-frequency transform element 26 of FIG. 4, preferably using the same transformation performed by transform element 32) thereby generating frequency-domain playback content data. The frequency-domain playback content data (for all channels) are downmixed (in the case that signal 25 includes two or more channels), and the resulting single stream of frequency-domain playback content data is banded (e.g., by element 27 of FIG. 4, preferably using the same banding operation performed by element 33 to generate the values M') to yield playback content values S (e.g., values S of FIG. 3 and FIG. 4). Values S should also be delayed in time (before they are processed in accordance with an embodiment of the invention, e.g., by element 13 of FIG. 3) to account for any latency (e.g., due to A/D and D/A conversion) in the hardware. This adjustment can be considered a coarse adjustment.

The FIG. 4 system includes an echo canceller 34, coupled and configured to generate echo cancelled noise estimate values by performing echo cancellation on the frequency domain values output from elements 26 and 32, and a banding subsystem 35, coupled and configured to perform frequency banding on the echo cancelled noise estimate values (residual values) output from echo canceller 34 to generate banded, echo cancelled noise estimate values M'res (including a value M'res for each frequency band).

In the case that signal 25 is multi-channel signal (comprising Z playback channels), a typical implementation of echo canceller 34 receives (from element 26) multiple streams of frequency-domain playback content values (one stream for each channel), and adapts a filter $W'_i$ (corresponding to filter W' of FIG. 2) for each playback channel. In this case, the frequency domain representation of the microphone output signal Y can be represented as $W_1X+W_2X+\ldots+W_ZX+N$, where each $W_i$ is a transfer function for a different one (the "i" th one) of the Z speakers. Such an implementation of echo canceller 34 subtracts each $W'_iX$ estimate (one per channel) from the frequency domain representation of the microphone output signal Y, to generate a single stream of echo cancelled noise estimate (or "residual") values corresponding to echo cancelled noise estimate values Y' of FIG. 2.

In general, an echo cancelled noise estimate is obtained by applying echo cancellation (wherein the echo results from or relates to the sound/audio content of the playback signal) to the microphone output signal. As such, an echo cancelled noise estimate (echo cancelled noise estimate value) may be said to be obtained by cancelling the echo resulting from or relating to the sound (or, put differently, resulting from or relating to the audio content of the playback signal) from the microphone output signal. This may be done in the frequency domain.

Figure 1:
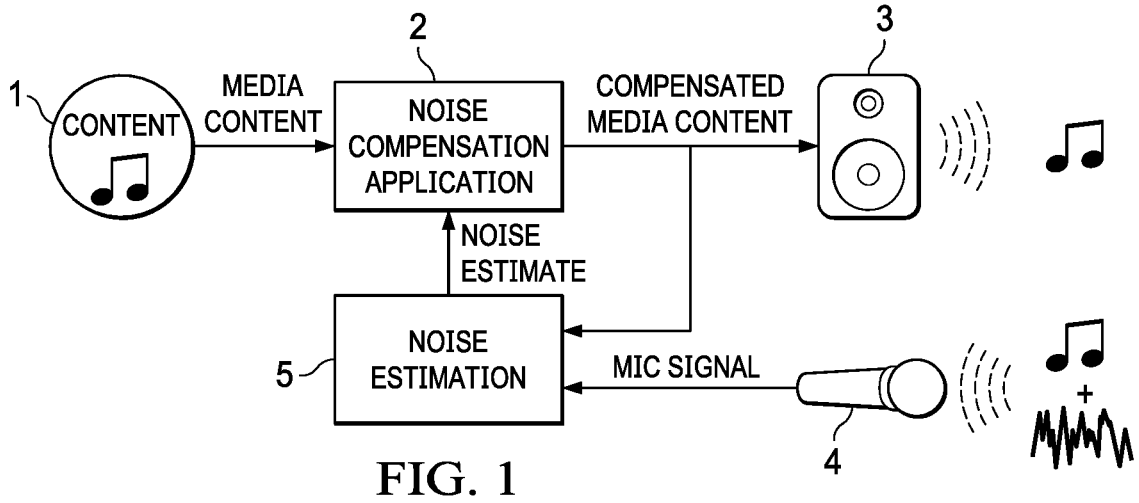
FIG. 1 is a block diagram of an audio playback system implementing noise compensated media playback (NCMP).
Figure 2:
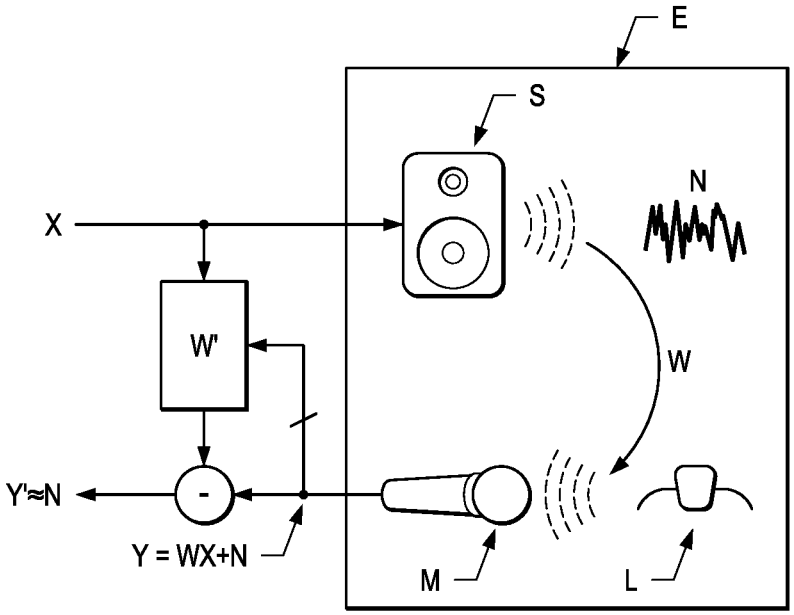
FIG. 2 (PRIOR ART)
FIG. 2 is a block diagram of a conventional system for generating a noise estimate, in accordance with the conventional method known as echo cancellation, from a microphone output signal. The microphone output signal is generated by capturing sound (indicative of playback content) and noise in a playback environment.

The filter coefficients of each adaptive filter employed by echo canceller 34 to generate the echo cancelled noise estimate values (i.e., each adaptive filter implemented by echo canceller 34 which corresponds to filter W' of FIG. 2) are banded in banding element 36. The banded filter coefficients are provided from element 36 to subsystem 43, for use by subsystem 43 to generate gain values G for use by subsystem 37.

Optionally, echo canceller 34 is omitted (or does not operate), and thus no adaptive filter values are provided to banding element 36, and no banded adaptive filter values are provided from 36 to subsystem 43. In this case, subsystem 43 generates the gain values G in one of the ways (described below) without use of banded adaptive filter values.

If an echo canceller is used (i.e. if the FIG. 4 system includes and uses elements 34 and 35 as shown in FIG. 4), the residual values output from echo canceller 34 are banded (e.g., in subsystem 35 of FIG. 4) to produce the banded noise estimate values M'res. Calibration gains G (generated by subsystem 43) are applied (e.g., by gain stage 12 of FIG. 3) to the values M'res (i.e., gains G includes a set of band-specific gains, one for each band, and each of the band-specific gains is applied to the values M'res in the corresponding band) to bring the signal (indicated by values M'res) into the same level domain as the playback signal (indicated by values S). For each frequency band, the corresponding one of the values M'res is adjusted in level using a calibration gain G (applied by gain stage 12 of FIG. 3) to produce an adjusted value Mres (i.e., one of the values Mres of FIG. 3).

If no echo canceller is used (i.e., if echo canceller 34 is omitted or does not operate), the values M'res (in the description herein of FIGS. 3 and 4) are replaced by the values M'. In this case, banded values M' (from element 33) are asserted to the input of gain stage 12 (in place of the values M'res shown in FIG. 3) as well as to the input of gain stage 11. Gains G are applied (by gain stage 12 of FIG. 3) to the values M' to generate adjusted values M, and the adjusted values M (rather than adjusted values Mres, as shown in FIG. 3) are handled by subsystem 20 (with the gap confidence values) in the same manner as (and instead of) the adjusted values Mres, to generate the noise estimate.

In typical implementations (including that shown in FIG. 3), noise estimate generation subsystem 37 is configured to perform minimum following on the playback content values S to locate gaps in (i.e., determined by) the adjusted versions (Mres) of the noise estimate values M'res. Preferably, this is implemented in a manner to be described with reference to FIG. 3.

In the implementation shown in FIG. 3, subsystem 37 includes a pair of minimum followers (13 and 14), both of which operate with the same sized analysis window. Minimum follower 13 is coupled and configured to run over the values S to produce the values $S_{min}$ which are indicative of the minimum value (in each analysis window) of the values S. Minimum follower 14 is coupled and configured to run over the values Mres to produce the values $M_{resmin}$, which are indicative of the minimum value (in each analysis window) of the values Mres. The inventors have recognized that, since the values S, M and Mres are at least roughly time aligned, in a gap in playback content (indicated by comparison of the playback content values S and the microphone output values M):

minima in the values Mres (the echo canceller residual) can confidently be considered to indicate estimates of noise in the playback environment; and minima in the M (microphone output signal) values can confidently be considered to indicate estimates of noise in the playback environment.

The inventors have also recognized that, at times other than during a gap in playback content, minima in the values Mres (or the values M) may not be indicative of accurate estimates of noise in the playback environment.

In response to microphone output signal (M) and the values of $S_{min}$, subsystem 16 generates gap confidence values. Sample aggregator subsystem 20 is configured to use the values of $M_{resmin}$ (or the values of M, in the case that no echo cancellation is performed) as candidate noise estimates, and to use the gap confidence values (generated by subsystem 16) as indications of the reliability of the candidate noise estimates.

More specifically, sample aggregator subsystem 20 of FIG. 3 operates to combine the candidate noise estimates ($M_{resmin}$) together in a fashion weighted by the gap confidence values (which have been generated in subsystem 16) to produce a final noise estimate for each analysis window (i.e., the analysis window of aggregator 20, having length τ2, as indicated in FIG. 3), with weighted candidate noise estimates corresponding to gap confidence values indicative of low gap confidence assigned no weight, or less weight than weighted candidate noise estimates corresponding to gap confidence values indicative of high gap confidence. Subsystem 20 thus uses the gap confidence values to output a sequence of noise estimates (a set of current noise estimates, including one noise estimate for each frequency band, for each analysis window).

A simple example of subsystem 20 is a minimum follower (of gap confidence weighted samples), e.g., a minimum follower that includes candidate samples (values of $M_{resmin}$) in the analysis window only if the associated gap confidence is higher than a predetermined threshold value (i.e., subsystem 20 assigns a weight of one to a sample $M_{resmin}$ if the gap confidence for the sample is equal to or greater than the threshold value, and subsystem 20 assigns a weight of zero to a sample $M_{resmin}$ if the gap confidence for the sample is less than the threshold value). Other implementations of subsystem 20 otherwise aggregate (e.g., determine an average of, or otherwise aggregate) gap confidence weighted samples (values of $M_{resmin}$, each weighted by a corresponding one of the gap confidence values, in an analysis window). An exemplary implementation of subsystem 20 which aggregates gap confidence weighted samples is (or includes) a linear interpolator/one pole smoother with an update rate controlled by the gap confidence values.

Subsystem 20 may employ strategies that ignore gap confidence at times when incoming samples (values of $M_{resmin}$) are lower than the current noise estimate (determined by subsystem 20), in order to track drops in noise conditions even if no gaps are available.

Preferably, subsystem 20 is configured to effectively hold onto noise estimates during intervals of low gap confidence until new sampling opportunities arise as determined by the gap confidence. For example, in a preferred implementation of subsystem 20, when subsystem 20 determines a current noise estimate (in one analysis window) and then the gap confidence values (generated by subsystem 16) indicate low confidence that there is a gap in playback content (e.g., the gap confidence values indicate gap confidence below a predetermined threshold value), subsystem 20 continues to output that current noise estimate until (in a new analysis window) the gap confidence values indicate higher confidence that there is a gap in playback content (e.g., the gap confidence values indicate gap confidence above the threshold value), at which time subsystem 20 generates (and outputs) an updated noise estimate. By so using gap confidence values to generate noise estimates (including by holding onto noise estimates during intervals of low gap confidence until new sampling opportunities arise as determined by the gap confidence) in accordance with preferred embodiments of the invention, rather than relying only on candidate noise estimate values output from minimum follower 14 as a sequence of noise estimates (without determining and using gap confidence values) or otherwise generating noise estimates in a conventional manner, the length for all employed minimum follower analysis windows (i.e., τ1, the analysis window length of each of minimum followers 13 and 14, and τ2, the analysis window length of aggregator 20, if aggregator 20 is implemented as a minimum follower of gap confidence weighted samples) can be reduced by about an order of magnitude over traditional approaches, improving the speed at which the noise estimation system can track the noise conditions when gaps do arise. Typical default values for the analysis window sizes are given below.

In a class of implementations, sample aggregator 20 is configured to report forward (i.e., to output) not only a current noise estimate but also an indication, referred to herein as "gap health," of how up to date the noise estimate is in each frequency band. In typical implementations, gap health is a unitless measure, calculated (in one typical implementation) as:

$$GH = \frac{\sum_{i}^{n} GapConfidence_i}{n}$$

where n is an integer, index i ranges from 1 to n, and the $GapConfidence_i$ values are the most recent n gap confidence values provided by subsystem 16 to sample aggregator 20. Typically, a gap health value (e.g., a value GH) is determined for each frequency band, with subsystem 16 generating (and providing to aggregator 20) a set of gap confidence values (one for each frequency band) for each analysis window of minimum follower 13 (so that the n most recent gap confidence values in the above example of GH are the n most recent gap confidence values for the relevant band).

In a class of implementations, gap confidence subsystem 16 is configured to process the $S_{min}$ values (output from minimum follower 13) and a smoothed version (i.e., smoothed values $M_{smoothed}$, output from smoothing subsystem 17 of subsystem 16) of the M values (output from gain stage 11), e.g., by comparing the $S_{min}$ values to the $M_{smoothed}$ values, in order to generate a sequence of gap confidence values. Typically, subsystem 16 generates (and provides to aggregator 20) a set of gap confidence values (one for each frequency band) for each analysis window of minimum follower 13, and the description herein pertains to generation of a gap confidence value for a particular frequency band (from values of $S_{min}$ and $M_{smoothed}$ for the band).

Each gap confidence value (for one band, at one time) indicates how indicative a corresponding one of the $M_{resmin}$ values (i.e., the $M_{resmin}$ value for the same band and time) is of the noise conditions in the playback environment. Each minimum ($M_{resmin}$) recognized (during a gap in playback content) by minimum follower 14 (which operates on the Mres values) can confidently be considered to be indicative of noise conditions in the playback environment. When there is no gap in playback content, a minimum ($M_{resmin}$) recognized by minimum follower 14 (which operates on the Mres values) cannot confidently be considered to be indicative of noise conditions in the playback environment since it may instead be indicative of a minimum ($S_{min}$) in the playback signal (S).

Subsystem 16 is typically implemented to generate each gap confidence value (a value GapConfidence, for a time t) to be indicative of how different $S_{min}$ is from the smoothed (average) level detected by the microphone ($M_{smoothed}$) at the time t. The further $S_{min}$ is from the smoothed (average) level detected by the microphone ($M_{smoothed}$), the greater is the confidence that there is a gap in playback content at the time t, and thus the greater is the confidence that a value $M_{resmin}$ representative of the noise conditions (at the time t) in is the playback environment.

The computation of each gap confidence value (i.e., the gap confidence value for each time, t, e.g., for each analysis window of minimum follower 13), for each band, is based on $S_{min}$, the minimum followed playback content energy level at the time, t, and $M_{smoothed}$, the smoothed microphone energy level at the same time, t. In a preferred embodiment, each gap confidence value output from subsystem 16 is a unitless value proportional to:

$$\frac{1}{\frac{S_{min} * \delta}{M_{smoothed} * C} + 1}$$

where * denotes multiplication, all the energy values ($S_{min}$ and $M_{smoothed}$) are in the linear domain, and δ and C are tuning parameters. Typically, the value of C is associated with the amount of echo cancellation provided by an echo canceller (e.g., element 34 of FIG. 4) operating on the microphone output. If no echo canceller is employed, the value of C is one. If an echo canceller is used, an estimate of the cancellation depth can be used to determine C.

The value of δ sets the required distance between the observed minimum of the playback content, and the smoothed microphone level. This parameter trades off error and stability with the update rate of the system, and will depend on how aggressive the noise compensation gains are.

Using $M_{smoothed}$ as a point of comparison means that the current gap confidence value takes into account the severity of making an error in the estimate of the noise, given the current conditions. Generally if δ is chosen to be large enough, the operation of the noise estimator will take advantage of the following scenarios. For a fixed value of $S_{min}$, an increased value of $M_{smoothed}$ implies that the gap confidence should increase. If $M_{smoothed}$ increases because the actual noise conditions increase significantly, allowing more error in the noise estimate due to residual echo is possible because the error will be small relative to the magnitude of the noise conditions. If $M_{smoothed}$ increases because the playback content increases in level, the impact of any error made in the noise estimate is also reduced because the noise compensator will not be performing much compensation. For a fixed value of $S_{min}$, a decreased value of $M_{smoothed}$ implies that the gap confidence should decrease. Any errors introduced through residual echo in the microphone output signal in this situation would have a large impact on the compensation experience, as they would be large with respect to the playback content. Thus it is appropriate for the noise estimator to be more conservative in computing the gap confidence under these conditions.

In applications with a strong employment of echo cancellation ("AEC"), where the cost of making errors is lower, δ can be relaxed (reduced), so that the noise estimate (output from subsystem of 20) is indicative of more frequent gaps. In AEC-free applications, δ can be increased in order for the noise estimate (output from subsystem of 20) to be indicative of only higher quality gaps.

The following table is a summary of tuning parameters of the FIG. 3 implementation of the inventive noise estimator (with the two columns on the right of the table indicating typical default values of the tuning parameters (δ, C, and τ1, the analysis window length of minimum followers 13 and 14, and τ2, the analysis window length of sample aggregator 20, with aggregator 20 implemented as a minimum follower of gap confidence weighted samples), in the case that echo cancellation ("AEC") is employed, and the case that echo cancellation is not employed:

| Parameter | Purpose | With AEC Default | No AEC Default |
|---|---|---|---|
| δ | Required distance between playback minimum and microphone level for gap. | 6 dB | 30 dB |
| C | Amount of cancellation expected due to echo cancellation. | Depends on AEC. | 0 dB (i.e., C = 1 in the linear domain) |
| τ1 | Size of minimum follower analysis windows (of minimum followers 13 and 14) operating on microphone residual energy and playback energy. | 200 ms | 200 ms |
| τ2 | Size of the minimum follower-like filter (20) that processes microphone residual energy levels and corresponding confidences. | 800 ms | 800 ms |

All of the tuning parameters affect the update rate of the system, which is balanced against the accuracy of the system's noise estimate. Generally, as long as stability is maintained, it is better to have a faster responding system with some error present, then a conservative, slow responding system that relies on high quality gaps.

The described approach to computing gap confidence (e.g., the output of subsystem 16 of FIG. 3) differs from an attempt at computing the current signal to noise ratio (SNR), the ratio of echo level to current noise levels. Any gap confidence computation that relies on the present noise estimate generally will not work as it will either sample too freely or too conservatively as soon as there is a change in the noise conditions. Although knowing the current SNR may be the best way (in an academic sense) to determine the gap confidence, this would require knowledge of the noise conditions, the very thing the noise estimator is trying to determine, leading to a cyclic dependency that doesn't work in practice.

With reference again to FIG. 4, we describe in more detail additional elements of the implementation (shown in FIG. 4) of a noise estimation system in accordance with a typical embodiment of the invention. As noted above, noise compensation is performed ((by subsystem 24) on playback content 23 using a noise estimate spectrum produced by noise estimator subsystem 37 (implemented as in FIG. 3, described above). The noise compensated playback content 25 is played over speaker system 29 to a listener (e.g., listener 31) in a playback environment (environment 28). Microphone 30 in the same acoustic environment (environment 28) as the listener receives both the environmental (surrounding) noise and the playback content (echo).

The noise compensated playback content 25 is transformed (in element 26), and downmixed and frequency banded (in element 27) to produce the values S. The microphone output signal is transformed (in element 32) and banded (in element 33) to produce the values M'. If an echo canceller (34) is employed, the residual signal (echo cancelled noise estimate values) from the echo canceller is banded (in element 35) to produce the values Mres'.

Subsystem 43 determines the calibration gain G (for each frequency band) in accordance with a microphone to digital mapping, which captures the level difference per frequency band between the playback content in the digital domain at the point (e.g., the output of time-to-frequency domain transform element 26) it is tapped off and provided to the noise estimator, and the playback content as received by the microphone. Each set of current values of the gain G is provided from subsystem 43 to noise estimator 37 (for application by gain stages 11 and 12 of the FIG. 3 implementation of noise estimator 37).

Subsystem 43 has access to at least one of the following three sources of data:

factory preset gains (stored in memory 40);

the state of the gains G generated (by subsystem 43) during the previous session (and stored in memory 41);

if an AEC (e.g., echo canceller 34) is present and in use, banded AEC filter coefficient energies (e.g., those which determine the adaptive filter, corresponding to filter W' of FIG. 2, implemented by the echo canceller). These banded AEC filter coefficient energies (e.g., those provided from banding element 36 to subsystem 43 in the FIG. 4 system) serve as an online estimation of the gains G.

If no AEC is employed (e.g., if a version of the FIG. 4 system is employed which does not include echo canceller 34), subsystem 43 generates the calibration gains G from the gain values in memory 40 or 41.

Thus, in some embodiments, subsystem 43 is configured such that the FIG. 4 system performs self-calibration by determining calibration gains (e.g., from banded AEC filter coefficient energies provided from banding element 36) for application by subsystem 37 to playback signal, microphone output signal, and echo cancellation residual values, to implement noise estimation.

With reference again to FIG. 4, the sequence of noise estimates produced by noise estimator 37 is optionally post-processed (in subsystem 39), including by performance of one or more of the following operations thereon:

imputation of missing noise estimate values from a partially updated noise estimate;

constraining of the shape of the current noise estimate to preserve timbre; and constraining of the absolute value of current noise estimate.

The microphone to digital mapping performed by subsystem 43 to determine the gain values G captures the level difference (per frequency band) between the playback content in the digital domain (e.g., the output of time-to-frequency domain transform element 26) at the point it is tapped off for provision to the noise estimator, and the playback content as received by the microphone. The mapping is primarily determined by the physical separation and characteristics of the speaker system and microphone, as well as the electrical amplification gains used in the reproduction of sound and microphone signal amplification.

In the most basic instance, the microphone to digital mapping may be a pre-stored factory tuning, measured during production design over a sample of devices, and re-used for all such devices being produced.

When an AEC (e.g., echo canceller 34 of FIG. 4) is used, more sophisticated control over the microphone to digital mapping is possible. An online estimate of the gains G can be determined by taking the magnitude of the adaptive filter coefficients (determined by the echo canceller) and banding them together. For a sufficiently stable echo canceller design, and with sufficient smoothing on the estimated gains (G'), this online estimate can be as good as an offline pre-prepared factory calibration. This makes it possible to use estimated gains G' in place of a factory tuning. Another benefit of calculating estimated gains G' is that any per-device deviations from the factory defaults can be measured and accounted for.

While estimated gains G' can substitute for factory determined gains, a robust approach to determining the gain G for each band, that combines both factory gains and the online estimated gains G', is the following:

$$G=\max(\min(G',F+L),F-L)$$

where F is the factory gain for the band, G' is the estimated gain for the band, and L is a maximum allowed deviation from the factory settings. All gains are in dB. If a value G' exceeds the indicated range for a long period of time, this may indicate faulty hardware, and the noise compensation system may decide to fall back to safe behavior.

A higher quality noise compensation experience can be maintained using a post-processing step performed (e.g., by element 39 of the FIG. 4 system) on the sequence of noise estimates generated (e.g., by element 37 of the FIG. 4 system) in accordance with an embodiment of the invention. For example, post-processing which forces a noise spectrum to conform to a particular shape in order to remove peaks may help prevent the compensation gains distorting the timbre of the playback content in an unpleasant way.

An important aspect of some embodiments of the inventive noise estimation method and system is post-processing (e.g., performed by an implementation of element 39 of the FIG. 4 system), e.g., post-processing which implements an imputation strategy to update old noise estimates (for some frequency bands) which have gone stale due to lack of gaps in the playback content, although noise estimates for other bands have been updated sufficiently.

In some such embodiments, the gap health as reported by the noise estimator (e.g., gap health values, for each frequency band, generated by subsystem 20 of the FIG. 3 implementation of the inventive noise estimator, e.g., as described above) determines which bands (of the current noise estimate) are "stale" or "up to date". An exemplary method (performed by an implementation of element 39 of the FIG. 4 system) employing gap health values (generated by noise estimator 37 for each frequency band) to impute noise estimate values, includes steps of:

starting from the first band, locate a sufficiently up to date band (a healthy band) by checking if the gap health for the band is above a predetermined threshold, $\alpha_{Healthy}$;

once a healthy band is found, check subsequent bands for low gap health, determined by a different threshold $\alpha_{stale}$, and again for up to date bands determined by the threshold $\alpha_{Healthy}$;

if a second healthy band is found, and all bands in between it and the first healthy band are stale, a linear interpolation operation is performed between the two healthy bands to generate at least one interpolated noise estimate. The noise estimate (for all bands between the two healthy bands) is linearly interpolated in the log domain between the two healthy bands, providing new values for the stale bands; and then, continue the processes (i.e., repeat the processes from the first step), starting from the next band.

Stale value imputation may not be necessary in embodiments where a sufficient number of gaps are constantly available, and bands are rarely stale. Default threshold values for the simple imputation algorithm are given by the following table:

| Parameter: | Default |
|---|---|
| $\alpha_{Healthy}$ | 0.5 |
| $\alpha_{Stale}$ | 0.3 |

Other methods that operate on the gap health and noise estimate values are of course possible.

In some embodiments, element 39 of the FIG. 4 system is implemented to perform automatic detection of system failure (e.g., hardware failure), e.g., using gap health values generated by noise estimator 37 for each frequency band, when echo cancellation (AEC) is employed in the generation of background noise estimates.

Gap confidence determination (and use of the determined gap confidence data to perform noise estimation) in accordance with typical embodiments of the invention as disclosed herein enables a viable noise compensation experience (using noise estimates determined using the gap confidence values) without the need for an echo canceller, across the range of audio types encountered in media playback scenarios. Including an echo canceller to perform gap confidence determination in accordance with some embodiments of the invention can improve the responsiveness of noise compensation (using noise estimates determined using the determined gap confidence data), removing dependency on playback content characteristics. Typical implementations of the gap confidence determination, and use of the determined gap confidence data to perform noise estimation, lower the requirements placed on an echo canceller (also used to perform the noise estimation), and the significant effort involved in optimisation and testing.

Removing an echo canceller from a noise compensation system:

saves a large amount of development time, as echo cancellers demand a large amount of time and research to tune to ensure cancellation performance and stability;

saves computation time, as large adaptive filter banks (for implementing echo cancellation) typically consume large resources and often require high precision arithmetic to run; and removes the need for shared clock domain and time alignment between the microphone signal and the playback audio signal. Echo cancellation relies on both playback and recording signals to be synchronized on the same audio clock.

A noise estimator (implemented in accordance with any of typical embodiments of the invention, e.g., without echo cancellation) can run at an increased block rate/smaller FFT size for further complexity savings. Echo cancellation performed in the frequency domain typically requires a narrow frequency resolution.

When using echo cancellation (and gap confidence determination) to generate noise estimates in accordance with typical embodiments of the invention, echo canceller performance can be reduced without compromising user experience (when the user listens to noise compensated playback content, implemented using noise estimates generated in accordance with typical embodiments of the invention), since the echo canceller need only perform enough cancellation to reveal gaps in playback content, and need not maintain a high ERLE for the playback content peaks ("ERLE" here denotes echo return loss enhancement, a measure of how much echo, in dB, is removed by an echo canceller).

Exemplary embodiments of the inventive method include the following:

E1. A method, including steps of:

during emission of sound in a playback environment, using a microphone to generate a microphone output signal, wherein the sound is indicative of audio content of a playback signal, and the microphone output signal is indicative of background noise in the playback environment and the audio content;

generating (e.g., in element 16 of the FIG. 3 system) gap confidence values in response to the microphone output signal and the playback signal, where each of the gap confidence values is for a different time, t, and is indicative of confidence that there is a gap, at the time t, in the playback signal; and generating (e.g., in element 20 of the FIG. 3 system) an estimate of the background noise in the playback environment using the gap confidence values.

E2. The method of claim E1, wherein the estimate of the background noise in the playback environment is or includes a sequence of noise estimates, each of the noise estimates is an estimate of background noise in the playback environment at a different time, t, and said each of the noise estimates (e.g., each noise estimate output from element 20 of the FIG. 3 system, which is an implementation of element 37 of FIG. 4) is a combination of candidate noise estimates which have been weighted by the gap confidence values for a different time interval including the time t.

E3. The method of claim E2, wherein the sequence of noise estimates includes a noise estimate for each said time interval, and generation of the noise estimate for each said time interval includes steps of:

(a) identifying (e.g., in element 20 of the FIG. 3 system) each of the candidate noise estimates for the time interval for which a corresponding one of the gap confidence values exceeds a predetermined threshold value; and (b) generating the noise estimate for the time interval to be a minimum one of the candidate noise estimates identified in step (a).

E4. The method of claim E2, wherein each of the candidate noise estimates is a minimum echo cancelled noise estimate (e.g., one of the values, $M_{resmin}$, output from element 14 of the FIG. 3 system) of a sequence of echo cancelled noise estimates, the sequence of noise estimates includes a noise estimate for each said time interval, and the noise estimate for each said time interval is a combination of the minimum echo cancelled noise estimates for the time interval, weighted by corresponding ones of the gap confidence values for the time interval.

E5. The method of claim E2, wherein each of the candidate noise estimates is a minimum microphone output signal value (e.g., a value, $M_{min}$, output from element 14 of the FIG. 3 system, in an implementation in which element 12 of the system receives microphone output values M' rather than values M'res) of a sequence of microphone output signal values, the sequence of noise estimates includes a noise estimate for each said time interval, and the noise estimate for each said time interval is a combination of the minimum microphone output signal values for the time interval, weighted by corresponding ones of the gap confidence values for the time interval.

E6. The method of claim E1, wherein the step of generating the gap confidence values includes generating a gap confidence value for each time, t, including by:

processing the playback signal (e.g., in element 13 of the FIG. 3 system) to determine a minimum in playback signal level for the time, t;

processing the microphone output signal (e.g., in elements 11 and 17 of the FIG. 3 system) to determine a smoothed level of the microphone output signal for the time, t; and determining (e.g., in element 18 of the FIG. 3 system) the gap confidence value for the time, t, to be indicative of how different the minimum in playback signal level for the time, t, is from the smoothed level of the microphone output signal for the time, t.

E7. The method of claim E1, wherein the estimate of the background noise in the playback environment is or includes a sequence of noise estimates, and also including a step of:

performing noise compensation (e.g., in element 24 of the FIG. 4 system) on an audio input signal using the sequence of noise estimates.

E8. The method of claim E7, wherein the step of performing noise compensation on the audio input signal includes generation of the playback signal, and wherein the method includes a step of:

driving at least one speaker with the playback signal to generate said sound.

E9. The method of claim E1, including steps of:

performing a time-domain to frequency-domain transform on the microphone output signal, thereby generating frequency-domain microphone output data; and generating frequency-domain playback content data in response to the playback signal, and wherein the gap confidence values are generated in response to the frequency-domain microphone output data and the frequency-domain playback content data.

Exemplary embodiments of the inventive system include the following:

E10. A system, including:

a microphone (e.g., microphone 30 of FIG. 4), configured to generate a microphone output signal during emission of sound in a playback environment, wherein the sound is indicative of audio content of a playback signal, and the microphone output signal is indicative of background noise in the playback environment and the audio content; and a noise estimation system (e.g., elements 26, 27, 32, 33, 34, 35, 36, 37, 39, and 43 of the FIG. 4 system), coupled to receive the microphone output signal and the playback signal, and configured:

to generate gap confidence values in response to the microphone output signal and the playback signal, where each of the gap confidence values is for a different time, t, and is indicative of confidence that there is a gap, at the time t, in the playback signal; and to generate an estimate of the background noise in the playback environment using the gap confidence values.

E11. The system of claim E10, wherein the noise estimation system is configured to generate the estimate of the background noise in the playback environment such that said estimate of the background noise in the playback environment is or includes a sequence of noise estimates, each of the noise estimates is an estimate of background noise in the playback environment at a different time, t, and said each of the noise estimates (e.g., each noise estimate output from element 20 of the FIG. 3 implementation of element 37 of FIG. 4) of is a combination of candidate noise estimates which have been weighted by the gap confidence values for a different time interval including the time t.

E12. The system of claim E11, wherein the sequence of noise estimates includes a noise estimate for each said time interval, and the noise estimation system is configured to generate the noise estimate for each said time interval including by:

(a) identifying (e.g., in element 20 of FIG. 3) each of the candidate noise estimates for the time interval for which a corresponding one of the gap confidence values exceeds a predetermined threshold value; and (b) generating the noise estimate for the time interval to be a minimum one of the candidate noise estimates identified in step (a).

E13. The system of claim E12, wherein each of the candidate noise estimates is a minimum echo cancelled noise estimate (e.g., one of the values, $M_{resmin}$, output from element 14 of the FIG. 3 system), of a sequence of echo cancelled noise estimates, the sequence of noise estimates includes a noise estimate for each said time interval, and the noise estimate for each said time interval is a combination of the minimum echo cancelled noise estimates for the time interval, weighted by corresponding ones of the gap confidence values for the time interval.

E14. The system of claim E12, wherein each of the candidate noise estimates is a minimum microphone output signal value (e.g., a value, $M_{min}$, output from element 14 of the FIG. 3 system, in an implementation in which element 12 of the system receives microphone output values M' rather than values M'res), of a sequence of microphone output signal values, the sequence of noise estimates includes a noise estimate for each said time interval, and the noise estimate for each said time interval is a combination of the minimum microphone output signal values for the time interval, weighted by corresponding ones of the gap confidence values for the time interval.

E15. The system of claim E10, wherein the gap confidence values include a gap confidence value for each time, t, and the noise estimation system is configured to generate the gap confidence value for each time, t, including by:

processing the playback signal (e.g., in element 13 of the FIG. 3 implementation of element 37 of FIG. 4 system) to determine a minimum in playback signal level for the time, t;

processing (e.g., in elements 11 and 17 of the FIG. 3 implementation of element 37 of FIG. 4 system) the microphone output signal to determine a smoothed level of the microphone output signal for the time, t; and determining (e.g., in element 18 of the FIG. 3 implementation of element 37 of FIG. 4 system) the gap confidence value for the time, t, to be indicative of how different the minimum in playback signal level for the time, t, is from the smoothed level of the microphone output signal for the time, t.

E16. The system of claim E10, wherein the estimate of the background noise in the playback environment is or includes a sequence of noise estimates, said system also including:

a noise compensation subsystem (e.g., element 24 of the FIG. 4 system), coupled to receive the sequence of noise estimates, and configured to perform noise compensation on an audio input signal using the sequence of noise estimates to generate the playback signal.

E17. The system of claim E10, wherein the noise estimation system is configured:

to perform a time-domain to frequency-domain transform (e.g., in elements 32 and 33 of the FIG. 4 system) on the microphone output signal, thereby generating frequency-domain microphone output data;

to generate frequency-domain playback content data (e.g., in elements 26 and 27 of the FIG. 4 system) in response to the playback signal; and to generate the gap confidence values in response to the frequency-domain microphone output data and the frequency-domain playback content data.

Aspects of the invention include a system or device configured (e.g., programmed) to perform any embodiment of the inventive method, and a tangible computer readable medium (e.g., a disc) which stores code for implementing any embodiment of the inventive method or steps thereof. For example, the inventive system can be or include a programmable general purpose processor, digital signal processor, or microprocessor, programmed with software or firmware and/or otherwise configured to perform any of a variety of operations on data, including an embodiment of the inventive method or steps thereof. Such a general purpose processor may be or include a computer system including an input device, a memory, and a processing subsystem that is programmed (and/or otherwise configured) to perform an embodiment of the inventive method (or steps thereof) in response to data asserted thereto.

Some embodiments of the inventive system (e.g., some implementations of the system of FIG. 3, or of elements 24, 26, 27, 34, 32, 33, 35, 36, 37, 39, and 43 of the FIG. 4 system) are implemented as a configurable (e.g., programmable) digital signal processor (DSP) that is configured (e.g., programmed and otherwise configured) to perform required processing on audio signal(s), including performance of an embodiment of the inventive method. Alternatively, embodiments of the inventive system (e.g., some implementations of the system of FIG. 3, or of elements 24, 26, 27, 34, 32, 33, 35, 36, 37, 39, and 43 of the FIG. 4 system) are implemented as a general purpose processor (e.g., a personal computer (PC) or other computer system or microprocessor, which may include an input device and a memory) which is programmed with software or firmware and/or otherwise configured to perform any of a variety of operations including an embodiment of the inventive method. Alternatively, elements of some embodiments of the inventive system are implemented as a general purpose processor or DSP configured (e.g., programmed) to perform an embodiment of the inventive method, and the system also includes other elements (e.g., one or more loudspeakers and/or one or more microphones). A general purpose processor configured to perform an embodiment of the inventive method would typically be coupled to an input device (e.g., a mouse and/or a keyboard), a memory, and a display device.

Another aspect of the invention is a computer readable medium (for example, a disc or other tangible storage medium) which stores code for performing (e.g., coder executable to perform) any embodiment of the inventive method or steps thereof.

While specific embodiments of the present invention and applications of the invention have been described herein, it will be apparent to those of ordinary skill in the art that many variations on the embodiments and applications described herein are possible without departing from the scope of the invention described and claimed herein. It should be understood that while certain forms of the invention have been shown and described, the invention is not to be limited to the specific embodiments described and shown or the specific methods described.

Various aspects of the present invention may be appreciated from the following enumerated example embodiments (EEEs):

1. A method, including steps of:

during emission of sound in a playback environment, using a microphone to generate a microphone output signal, wherein the sound is indicative of audio content of a playback signal, and the microphone output signal is indicative of background noise in the playback environment and the audio content;

generating gap confidence values in response to the microphone output signal and the playback signal, where each of the gap confidence values is for a different time, t, and is indicative of confidence that there is a gap, at the time t, in the playback signal; and generating an estimate of the background noise in the playback environment using the gap confidence values.

2. The method of EEE 1, wherein the estimate of the background noise in the playback environment is or includes a sequence of noise estimates, each of the noise estimates is an estimate of background noise in the playback environment at a different time, t, and said each of the noise estimates is a combination of candidate noise estimates which have been weighted by the gap confidence values for a different time interval including the time t.

3. The method of EEE 2, wherein the sequence of noise estimates includes a noise estimate for each said time interval, and generation of the noise estimate for each said time interval includes steps of:

(a) identifying each of the candidate noise estimates for the time interval for which a corresponding one of the gap confidence values exceeds a predetermined threshold value; and (b) generating the noise estimate for the time interval to be a minimum one of the candidate noise estimates identified in step (a).

4. The method of EEE 2 or 3, wherein each of the candidate noise estimates is a minimum echo cancelled noise estimate, $M_{resmin}$, of a sequence of echo cancelled noise estimates, the sequence of noise estimates includes a noise estimate for each said time interval, and the noise estimate for each said time interval is a combination of the minimum echo cancelled noise estimates for the time interval, weighted by corresponding ones of the gap confidence values for the time interval.

5. The method of EEE 2 or 3, wherein each of the candidate noise estimates is a minimum microphone output signal value, $M_{min}$, of a sequence of microphone output signal values, the sequence of noise estimates includes a noise estimate for each said time interval, and the noise estimate for each said time interval is a combination of the minimum microphone output signal values for the time interval, weighted by corresponding ones of the gap confidence values for the time interval.

6. The method of EEE 1, 2, 3, 4, or 5, wherein the step of generating the gap confidence values includes generating a gap confidence value for each time, t, including by:

processing the playback signal to determine a minimum in playback signal level for the time, t;

processing the microphone output signal to determine a smoothed level of the microphone output signal for the time, t; and determining the gap confidence value for the time, t, to be indicative of how different the minimum in playback signal level for the time, t, is from the smoothed level of the microphone output signal for the time, t.

7. The method of EEE 1, 2, 3, 4, 5, or 6, wherein the estimate of the background noise in the playback environment is or includes a sequence of noise estimates, and also including a step of:

performing noise compensation on an audio input signal using the sequence of noise estimates.

8. The method of EEE 7, wherein the step of performing noise compensation on the audio input signal includes generation of the playback signal, and wherein the method includes a step of:

driving at least one speaker with the playback signal to generate said sound.

9. The method of EEE 1, 2, 3, 4, 5, 6, 7, or 8, including steps of:

performing a time-domain to frequency-domain transform on the microphone output signal, thereby generating frequency-domain microphone output data; and generating frequency-domain playback content data in response to the playback signal, and wherein the gap confidence values are generated in response to the frequency-domain microphone output data and the frequency-domain playback content data.

10. A system, including:

a microphone, configured to generate a microphone output signal during emission of sound in a playback environment, wherein the sound is indicative of audio content of a playback signal, and the microphone output signal is indicative of background noise in the playback environment and the audio content; and a noise estimation system, coupled to receive the microphone output signal and the playback signal, and configured:

to generate gap confidence values in response to the microphone output signal and the playback signal, where each of the gap confidence values is for a different time, t, and is indicative of confidence that there is a gap, at the time t, in the playback signal; and to generate an estimate of the background noise in the playback environment using the gap confidence values.

11. The system of EEE 10, wherein the noise estimation system is configured to generate the estimate of the background noise in the playback environment such that said estimate of the background noise in the playback environment is or includes a sequence of noise estimates, each of the noise estimates is an estimate of background noise in the playback environment at a different time, t, and said each of the noise estimates is a combination of candidate noise estimates which have been weighted by the gap confidence values for a different time interval including the time t.

12. The system of EEE 11, wherein the sequence of noise estimates includes a noise estimate for each said time interval, and the noise estimation system is configured to generate the noise estimate for each said time interval including by:

(a) identifying each of the candidate noise estimates for the time interval for which a corresponding one of the gap confidence values exceeds a predetermined threshold value; and (b) generating the noise estimate for the time interval to be a minimum one of the candidate noise estimates identified in step (a).

13. The system of EEE 11 or 12, wherein each of the candidate noise estimates is a minimum echo cancelled noise estimate, $M_{resmin}$, of a sequence of echo cancelled noise estimates, the sequence of noise estimates includes a noise estimate for each said time interval, and the noise estimate for each said time interval is a combination of the minimum echo cancelled noise estimates for the time interval, weighted by corresponding ones of the gap confidence values for the time interval.

14. The system of EEE 11 or 12, wherein each of the candidate noise estimates is a minimum microphone output signal value, $M_{min}$, of a sequence of microphone output signal values, the sequence of noise estimates includes a noise estimate for each said time interval, and the noise estimate for each said time interval is a combination of the minimum microphone output signal values for the time interval, weighted by corresponding ones of the gap confidence values for the time interval.

15. The system of EEE 10, 11, 12, 13, or 14, wherein the gap confidence values include a gap confidence value for each time, t, and the noise estimation system is configured to generate the gap confidence value for each time, t, including by:

processing the playback signal to determine a minimum in playback signal level for the time, t;

processing the microphone output signal to determine a smoothed level of the microphone output signal for the time, t; and determining the gap confidence value for the time, t, to be indicative of how different the minimum in playback signal level for the time, t, is from the smoothed level of the microphone output signal for the time, t.

16. The system of EEE 10, 11, 12, 13, 14, or 15, wherein the estimate of the background noise in the playback environment is or includes a sequence of noise estimates, said system also including:

a noise compensation subsystem, coupled to receive the sequence of noise estimates, and configured to perform noise compensation on an audio input signal using the sequence of noise estimates to generate the playback signal.

17. The system of EEE 10, 11, 12, 13, 14, 15, or 16, wherein the noise estimation system is configured:

to perform a time-domain to frequency-domain transform on the microphone output signal, thereby generating frequency-domain microphone output data;

to generate frequency-domain playback content data in response to the playback signal; and to generate the gap confidence values in response to the frequency-domain microphone output data and the frequency-domain playback content data.

The invention claimed is:

1. A method of generating an estimate of background noise in a playback environment, including steps of:

during emission of sound in the playback environment, using a microphone to generate a microphone output signal, wherein the sound is indicative of audio content of a playback signal, and the microphone output signal is indicative of the audio content and background noise in the playback environment;

generating gap confidence values in response to the microphone output signal and the playback signal, where each of the gap confidence values is for a different time, t, and is indicative of a confidence that there is a gap, at the time t, in the playback signal, wherein gap denotes a time or time interval of the playback signal at or in which playback content is missing or has a level less than a predetermined threshold, and wherein generating the gap confidence values includes generating a gap confidence value for each time, t, including by:

processing the playback signal to determine a minimum in playback signal level for the time, t;

processing the microphone output signal to determine a smoothed level of the microphone output signal for the time, t; and determining the gap confidence value for the time, t, to be indicative of how different the minimum in playback signal level for the time, t, is from the smoothed level of the microphone output signal for the time, t; and generating an estimate of the background noise in the playback environment using the gap confidence values.

2. The method of claim 1, wherein the estimate of the background noise in the playback environment is or includes a sequence of noise estimates, each of the noise estimates is an estimate of background noise in the playback environment at a different time, t, and said each of the noise estimates is a combination of candidate noise estimates for a different time interval including the time t, wherein the candidate noise estimates have been weighted by the gap confidence values.

3. The method of claim 1, wherein the estimate of the background noise in the playback environment is or includes a sequence of noise estimates, each of the noise estimates is an estimate of background noise in the playback environment at a different time, t; and wherein generating the estimate of the background noise in the playback environment using the gap confidence values involves, for each noise estimate, weighting candidate noise estimates for a different time interval including the time t by the gap confidence values and combining the weighted candidate noise estimates to obtain the respective noise estimate.

4. The method of claim 2, wherein the sequence of noise estimates includes a noise estimate for each said time interval, and generation of the noise estimate for each said time interval includes steps of:

(a) identifying each of the candidate noise estimates for the time interval for which a corresponding one of the gap confidence values exceeds a predetermined threshold value; and (b) generating the noise estimate for the time interval to be a minimum one of the candidate noise estimates identified in step (a).

5. The method of claim 2, wherein each of the candidate noise estimates is a minimum echo cancelled noise estimate, $M_{resmin}$, of a sequence of echo cancelled noise estimates, the sequence of noise estimates includes a noise estimate for each said time interval, and the noise estimate for each said time interval is a combination of the minimum echo cancelled noise estimates for the time interval, weighted by corresponding ones of the gap confidence values for the time interval, wherein the minimum echo cancelled noise estimate is obtained by performing minimum following on the sequence of echo cancelled noise estimates.

6. The method of claim 2, wherein each of the candidate noise estimates is a minimum microphone output signal value, $M_{min}$, of a sequence of microphone output signal values, the sequence of noise estimates includes a noise estimate for each said time interval, and the noise estimate for each said time interval is a combination of the minimum microphone output signal values for the time interval, weighted by corresponding ones of the gap confidence values for the time interval.

7. The method of claim 1, wherein the estimate of the background noise in the playback environment is or includes a sequence of noise estimates, and also including a step of:

performing noise compensation on an audio input signal using the sequence of noise estimates.

8. The method of claim 7, wherein the step of performing noise compensation on the audio input signal includes generation of the playback signal, and wherein the method includes a step of:

driving at least one speaker with the playback signal to generate said sound.

9. The method of claim 1, including steps of:

performing a time-domain to frequency-domain transform on the microphone output signal, thereby generating frequency-domain microphone output data; and generating frequency-domain playback content data in response to the playback signal, and wherein the gap confidence values are generated in response to the frequency-domain microphone output data and the frequency-domain playback content data.

10. A system, including:

a microphone, configured to generate a microphone output signal during emission of sound in a playback environment, wherein the sound is indicative of audio content of a playback signal, and the microphone output signal is indicative of background noise in the playback environment and the audio content; and a noise estimation system, coupled to receive the microphone output signal and the playback signal, and configured:

to generate gap confidence values in response to the microphone output signal and the playback signal, where each of the gap confidence values is for a different time, t, and is indicative of a confidence that there is a gap, at the time t, in the playback signal, wherein gap denotes a time or time interval of the playback signal at or in which playback content is missing or has a level less than a predetermined threshold, wherein the gap confidence values include a gap confidence value for each time, t, and the noise estimation system is configured to generate the gap confidence value for each time, t, including by:

processing the playback signal to determine a minimum in playback signal level for the time, t;

processing the microphone output signal to determine a smoothed level of the microphone output signal for the time, t; and determining the gap confidence value for the time, t, to be indicative of how different the minimum in playback signal level for the time, t, is from the smoothed level of the microphone output signal for the time, t; and to generate an estimate of the background noise in the playback environment using the gap confidence values.

11. The system of claim 10, wherein the noise estimation system is configured to generate the estimate of the background noise in the playback environment such that said estimate of the background noise in the playback environment is or includes a sequence of noise estimates, each of the noise estimates is an estimate of background noise in the playback environment at a different time, t, and said each of the noise estimates is a combination of candidate noise estimates for a different time interval including the time t, wherein the candidate noise estimates have been weighted by the gap confidence values.

12. The system of claim 10, wherein the noise estimation system is configured to generate the estimate of the background noise in the playback environment such that said estimate of the background noise in the playback environment is or includes a sequence of noise estimates, each of the noise estimates is an estimate of background noise in the playback environment at a different time, t, wherein generating the estimate of the background noise in the playback environment using the gap confidence values involves, for each noise estimate, weighting candidate noise estimates for a different time interval including the time t by the gap confidence values and combining the weighted candidate noise estimates to obtain the respective noise estimate.

13. The system of claim 11, wherein the sequence of noise estimates includes a noise estimate for each said time interval, and the noise estimation system is configured to generate the noise estimate for each said time interval including by:

(a) identifying each of the candidate noise estimates for the time interval for which a corresponding one of the gap confidence values exceeds a predetermined threshold value; and (b) generating the noise estimate for the time interval to be a minimum one of the candidate noise estimates identified in step (a).

14. The system of claim 11, wherein each of the candidate noise estimates is a minimum echo cancelled noise estimate, $M_{resmin}$, of a sequence of echo cancelled noise estimates, the sequence of noise estimates includes a noise estimate for each said time interval, and the noise estimate for each said time interval is a combination of the minimum echo cancelled noise estimates for the time interval, weighted by corresponding ones of the gap confidence values for the time interval, wherein the minimum echo cancelled noise estimate is obtained by performing minimum following on the sequence of echo cancelled noise estimates.

15. The system of claim 11, wherein each of the candidate noise estimates is a minimum microphone output signal value, $M_{min}$, of a sequence of microphone output signal values, the sequence of noise estimates includes a noise estimate for each said time interval, and the noise estimate for each said time interval is a combination of the minimum microphone output signal values for the time interval, weighted by corresponding ones of the gap confidence values for the time interval.

16. The system of claim 10, wherein the estimate of the background noise in the playback environment is or includes a sequence of noise estimates, said system also including:

a noise compensation subsystem, coupled to receive the sequence of noise estimates, and configured to perform noise compensation on an audio input signal using the sequence of noise estimates to generate the playback signal.

17. The system of claim 10, wherein the noise estimation system is configured:

to perform a time-domain to frequency-domain transform on the microphone output signal, thereby generating frequency-domain microphone output data;

to generate frequency-domain playback content data in response to the playback signal; and to generate the gap confidence values in response to the frequency-domain microphone output data and the frequency-domain playback content data.

* * * * *